US009145742B2

(12) United States Patent
Hall et al.

(10) Patent No.: US 9,145,742 B2
(45) **Date of Patent: *Sep. 29, 2015**

(54) POINTED WORKING ENDS ON A DRILL BIT

(71) Applicant: Schlumberger Technology Corporation, Sugar Land, TX (US)

(72) Inventors: David R. Hall, Provo, UT (US); Ronald B. Crockett, Provo, UT (US); John D. Bailey, Houston, TX (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/101,972

(22) Filed: Dec. 10, 2013

(65) Prior Publication Data

US 2014/0097028 A1 Apr. 10, 2014

Related U.S. Application Data

(63) Continuation of application No. 11/829,577, filed on Jul. 27, 2007, now Pat. No. 8,622,155, which is a continuation-in-part of application No. 11/774,227, filed on Jul. 6, 2007, now Pat. No. 7,669,938, which is a continuation-in-part of application No. 11/773,271, filed on Jul. 3, 2007, now Pat. No. 7,997,661, which is a continuation-in-part of application No. 11/766,903, filed on Jun. 22, 2007, now abandoned, which is a continuation of application No. 11/766,865, filed on Jun. 22, 2007, now abandoned, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, said application No. 11/829,577 is a continuation-in-part of application No. 11/766,975, filed on Jun. 22, 2007, now Pat. No. 8,122,980, and a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.

| | |
|---|---|
| ***E21B 10/55*** | (2006.01) |
| ***E21B 10/567*** | (2006.01) |
| ***E21B 10/43*** | (2006.01) |

(52) U.S. Cl.

CPC ..... *E21B 10/567* (2013.01); *E21B 10/43* (2013.01); *E21B 10/55* (2013.01)

(58) Field of Classification Search

CPC ..... E21B 10/567; E21B 10/55; E21B 10/43
USPC ..... 175/431, 434, 428
See application file for complete search history.

(56) References Cited

U.S. PATENT DOCUMENTS

| | | | | |
|---|---|---|---|---|
| 4,640,374 | A * | 2/1987 | Dennis | 175/393 |
| 5,120,327 | A * | 6/1992 | Dennis | 51/293 |
| 6,332,503 | B1 * | 12/2001 | Pessier et al. | 175/336 |
| 8,567,532 | B2 * | 10/2013 | Hall et al. | 175/428 |
| 8,590,644 | B2 * | 11/2013 | Hall et al. | 175/426 |
| 8,622,155 | B2 * | 1/2014 | Hall et al. | 175/431 |

*Primary Examiner* — John Kreck

(57) ABSTRACT

In one aspect of the present invention, a drill string has a drill bit with a body intermediate a shank and a working face. The working face has a plurality of blades converging at a center of the working surface and diverging towards a gauge of the working face. At least one blade has a cutting element with a carbide substrate bonded to a diamond working end with a pointed geometry. The diamond working end also has a central axis which intersects an apex of the pointed geometry. The axis is oriented between a 25 and 85 degree positive rake angle.

20 Claims, 12 Drawing Sheets

200H
601H
1150
202H
201H
605H
1151

603
200I
602
202I
201I
605I
1201

604
200J
1300
202J
201J
605J
1200

200K
1400
202K
201K
1150
605K 200L
601L
1500
202L
201L 200M
202M
201M
1600

200N
202N
1702
1700
1701
201N 200O
1804
1802
1801
1800
202O
201O

POINTED WORKING ENDS ON A DRILL BIT

CROSS REFERENCE TO RELATED APPLICATION

This application is a continuation application of U.S. patent application Ser. No. 11/829,577 ("the '577 application" filed on Jul. 27, 2007 which is a continuation-in-part of U.S. patent application Ser. No. 11/766,975 and was filed on Jun. 22, 2007. The '577 application is also a continuation-in-part of U.S. patent application Ser. No. 11/774,227 which was filed on Jul. 6, 2007. U.S. patent application Ser. No. 11/774,227 is a continuation-in-part of U.S. patent application Ser. No. 11/773,271 which was filed on Jul. 3, 2007. U.S. application Ser. No. 11/773,271 is a continuation-in-part of U.S. application Ser. No. 11/766,903 filed on Jun. 22, 2007. U.S. patent application Ser. No. 11/766,903 is a continuation of U.S. patent application Ser. No. 11/766,865 filed on Jun. 22, 2007. U.S. patent application Ser. No. 11/766,865 is a continuation-in-part of U.S. patent application Ser. No. 11/742,304 filed on Apr. 30, 2007. U.S. patent application Ser. No. 11/742,304 is a continuation of U.S. patent application Ser. No. 11/742,261 filed on Apr. 30, 2007. U.S. patent application Ser. No. 11/742,261 is a continuation-in-part of U.S. patent application Ser. No. 11/464,008 filed on Aug. 11, 2006. U.S. patent application Ser. No. 11/464,008 is a continuation-in-part of U.S. patent application Ser. No. 11/463,998 which was filed on Aug. 11, 2006. U.S. patent application Ser. No. 11/463,998 is a continuation-in-part of U.S. patent application Ser. No. 11/463,990 which was filed on Aug. 11, 2006. U.S. patent application Ser. No. 11/463,990 is a continuation-in-part of U.S. patent application Ser. No. 11/463,975 which was filed on Aug. 11, 2006. U.S. patent application Ser. No. 11/463,975 is a continuation-in-part of U.S. patent application Ser. No. 11/463,962 which was filed on Aug. 11, 2006. U.S. patent application Ser. No. 11/463,962 is a continuation-in-part of U.S. patent application Ser. No. 11/463,953, which was also filed on Aug. 11, 2006. The '577 application is also a continuation-in-part of U.S. patent application Ser. No. 11/695,672 which was filed on Apr. 3, 2007. U.S. patent application Ser. No. 11/695,672 is a continuation-in-part of U.S. patent application Ser. No. 11/686,831 filed on Mar. 15, 2007. All of these application are herein incorporated by reference for all that they contain.

BACKGROUND OF THE INVENTION

This invention relates to drill bits, specifically drill bit assemblies for use in oil, gas and geothermal drilling. More particularly, the invention relates to cutting elements in rotary drag bits comprised of a carbide substrate with a non-planar interface and an abrasion resistant layer of superhard material affixed thereto using a high pressure high temperature (HPHT) press apparatus. Such cutting elements typically comprise a superhard material layer or layers formed under high temperature and pressure conditions, usually in a press apparatus designed to create such conditions, cemented to a carbide substrate containing a metal binder or catalyst such as cobalt. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the HPHT apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such cutting elements are often subjected to intense forces, torques, vibration, high temperatures and temperature differentials during operation. As a result, stresses within the structure may begin to form. Drag bits for example may exhibit stresses aggravated by drilling anomalies during well boring operations such as bit whirl or bounce often resulting in spalling, delamination or fracture of the superhard abrasive layer or the substrate thereby reducing or eliminating the cutting elements efficacy and decreasing overall drill bit wear life. The superhard material layer of a cutting element sometimes delaminates from the carbide substrate after the sintering process as well as during percussive and abrasive use. Damage typically found in drag bits may be a result of shear failures, although non-shear modes of failure are not uncommon. The interface between the superhard material layer and substrate is particularly susceptible to non-shear failure modes due to inherent residual stresses.

U.S. Pat. No. 6,332,503 to Pessier et al., which is herein incorporated by reference for all that it contains, discloses an array of chisel-shaped cutting elements mounted to the face of a fixed cutter bit, each cutting element has a crest and an axis which is inclined relative to the borehole bottom. The chisel-shaped cutting elements may be arranged on a selected portion of the bit, such as the center of the bit, or across the entire cutting surface. In addition, the crest on the cutting elements may be oriented generally parallel or perpendicular to the borehole bottom.

U.S. Pat. No. 6,059,054 to Portwood et al., which is herein incorporated by reference for all that it contains, discloses a cutter element that balances maximum gage-keeping capabilities with minimal tensile stress induced damage to the cutter elements is disclosed. The cutter elements of the present invention have a non-symmetrical shape and may include a more aggressive cutting profile than conventional cutter elements. In one embodiment, a cutter element is configured such that the inside angle at which its leading face intersects the wear face is less than the inside angle at which its trailing face intersects the wear face. This can also be accomplished by providing the cutter element with a relieved wear face. In another embodiment of the invention, the surfaces of the present cutter element are curvilinear and the transitions between the leading and trailing faces and the gage face are rounded, or contoured. In this embodiment, the leading transition is made sharper than the trailing transition by configuring it such that the leading transition has a smaller radius of curvature than the radius of curvature of the trailing transition. In another embodiment, the cutter element has a chamfered trailing edge such that the leading transition of the cutter element is sharper than its trailing transition. In another embodiment, the cutter element has a chamfered or contoured trailing edge in combination with a canted wear face. In still another embodiment, the cutter element includes a positive rake angle on its leading edge.

BRIEF SUMMARY OF THE INVENTION

In one aspect of the present invention, a drill string has a drill bit with a body intermediate a shank and a working face. The working face has a plurality of blades converging at a center of the working surface and diverging towards a gauge of the working face. At least one blade has a cutting element with a carbide substrate bonded to a diamond working end with a pointed geometry. The diamond working end also has a central axis which intersects an apex of the pointed geometry. The axis is oriented between a 25 and 85 degree positive rake angle. More specifically, the axis may be oriented between a 35 and 50 degree positive rake angle.

During a drilling operation, 40 to 60 percent of the cuttings produced may have a volume of 0.5 to 10 cubic centimeters. The cuttings may have a substantially wedge geometry tapering at a 5 to 30 degree angle. The apex may have a 0.050 to 0.200 inch radius and the diamond working end may have a 0.100 to 0.500 inch thickness from the apex to the non-planar interface. The carbide substrate may have a thickness of 0.200 to 1 inch from a base of the carbide substrate to the non-planar interface. The cutting element may produce a 0.100 to 0.350 inch depth of cut during a drilling operation.

The diamond working end may comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. The formation being drilled may comprise limestone, sandstone, granite, or combinations thereof. More particularly, the formation may comprise a Mohs hardness of 5.5 to 7.

The cutting element may comprise a length of 0.50 to 2 inches and may be rotationally isolated with respect to the drill bit. In some embodiments, the central axis of the cutting element may be tangent to a cutting path formed by the working face of the drill bit during a downhole drilling operation. In other embodiments, the central axis may be positioned at an angle relative to the cutting path. The angle of at least one cutting element on a blade may be offset from an angle of at least one cutting element on an adjacent blade. A cutting element on a blade may be oriented at a different angle than an adjacent cutting element on the same blade. At least one cutting element may be arrayed along any portion of the blade, including a cone portion, a nose portion, a flank portion, and a gauge portion. A jack element coaxial with an axis of rotation may extend out of an opening disposed in the working face.

In another aspect of the present invention, a method has the steps for forming a wellbore. A drill bit has a body intermediate a shank and a working face. The working face has a plurality of blades extending outwardly from the bit body. At least one blade has a cutting element with a carbide substrate bonded to a diamond working end with a pointed geometry. The drill bit is deployed on a drill string within a wellbore. The diamond working end is positioned adjacent a downhole formation between a 25 and 85 degree positive rake angle with respect to a central axis of the drill bit. The downhole formation is degraded with the diamond working end. The step of degrading the formation may include rotating the drill string. The drill bit may rotate at 90 to 150 RPM during a drilling operation.

In another aspect of the present invention a drill string has a drill bit with a body intermediate a shank and a working face. The working face has at least one cutting element with a carbide substrate bonded to a diamond working end with a pointed geometry at a non-planar interface. The diamond working end has a central axis which intersects an apex of the pointed geometry. The axis is oriented between a 25 and 85 degree positive rake angle.

DETAILED DESCRIPTION OF THE INVENTION AND THE PREFERRED EMBODIMENT

Figure 1:
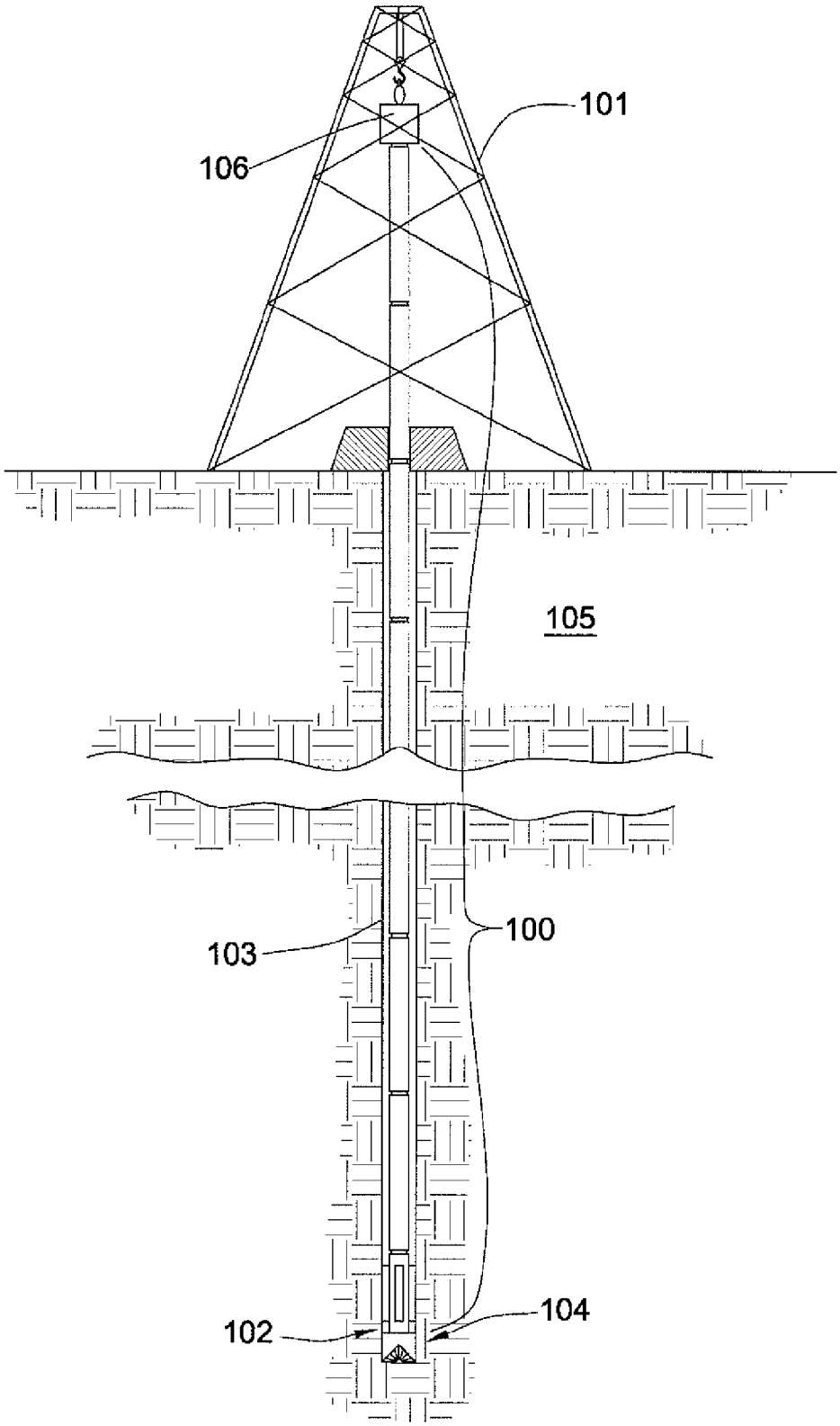
FIG. 1 is a perspective diagram of an embodiment of a drill string suspended in a wellbore.

FIG. 1 is a perspective diagram of an embodiment of a drill string 100 suspended by a derrick 101. A bottom-hole assembly 102 is located at the bottom of a wellbore 103 and comprises a drill bit 104. As the drill bit 104 rotates downhole the drill string 100 advances farther into the earth. The drill string 100 may penetrate soft or hard subterranean formations 105. The drill bit 104 may break up the formations 105 by cutting and/or chipping the formation 105 during a downhole drilling operation. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102. U.S. Pat. No. 6,670,880 which is herein incorporated by reference fir all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 1A:
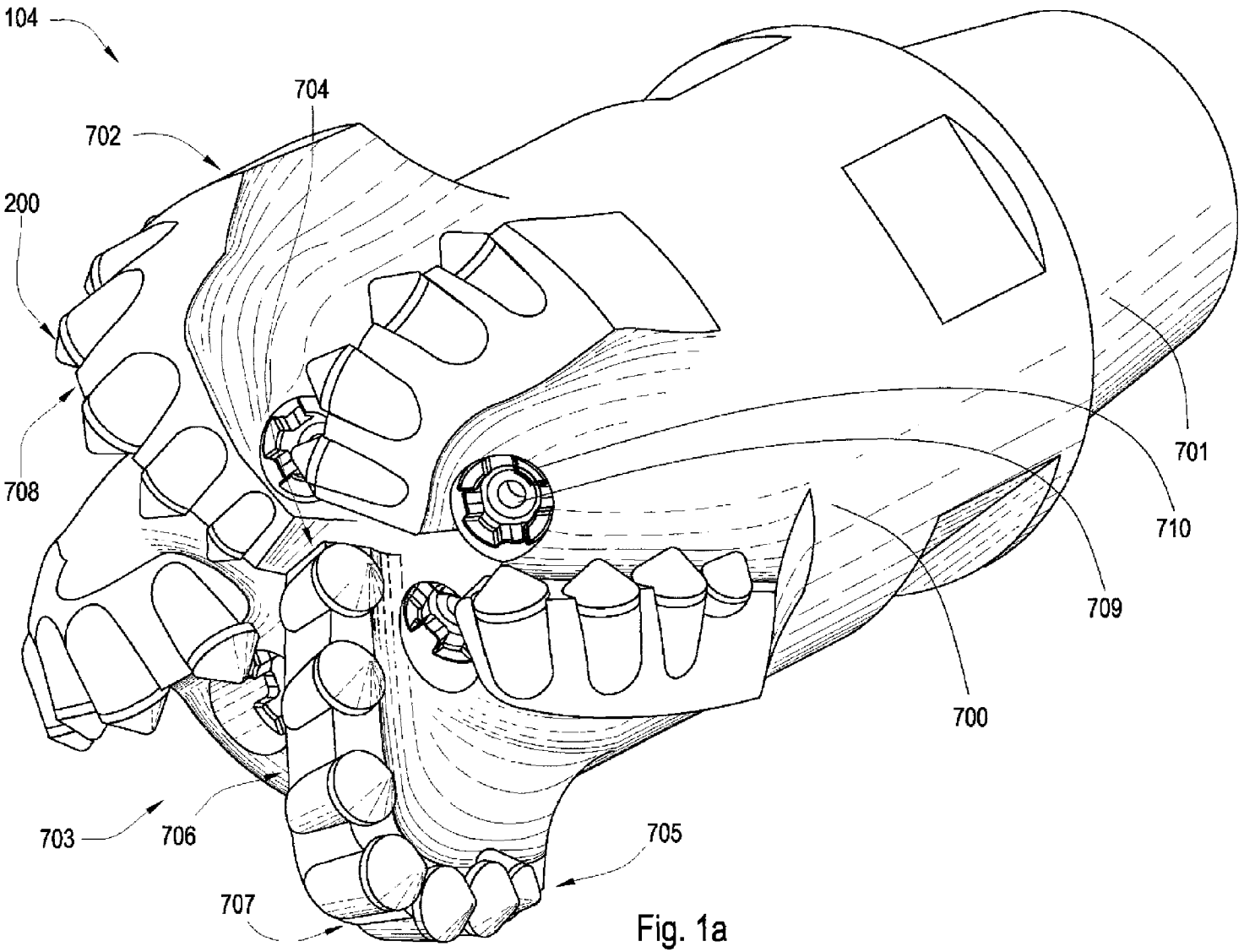
FIG. 1*a* is a perspective diagram of an embodiment of a drill bit.

In the embodiment of FIG. 1*a*, cutting elements 200 are incorporated onto a drill bit 104 having a body 700 intermediate a shank 701 and a working face 702. The shank 701 may be adapted for connection to a downhole drill string. The drill bit 104 of the present invention may be intended for deep oil and gas drilling, although any type of drilling application is anticipated such as horizontal drilling, geothermal drilling, exploration, on and off-shore drilling, directional drilling, water well drilling and any combination thereof. The working face 702 may have a plurality of blades 703 converging at a center 704 of the working face 702 and diverging towards a gauge portion 705 of the working face 702. Preferably, the drill bit 104 may have between three and seven blades 703. At least one blade 703 may have at least one cutting element 200 with a carbide substrate bonded to a diamond working end with a pointed geometry. Cutting elements 200 may be arrayed along any portion of the blades 703, including a cone portion 706, a nose portion 707, a flank portion 708, and the gauge portion 705. A plurality of nozzles 709 may be disposed into recesses 710 formed in the working face 702. Each nozzle 709 may be oriented such that a jet of drilling mud ejected from the nozzles 709 engages the formation before or after the cutting elements 200. The jets of drilling mud may also be used to clean cuttings away from the drill bit 104.

Figure 2:
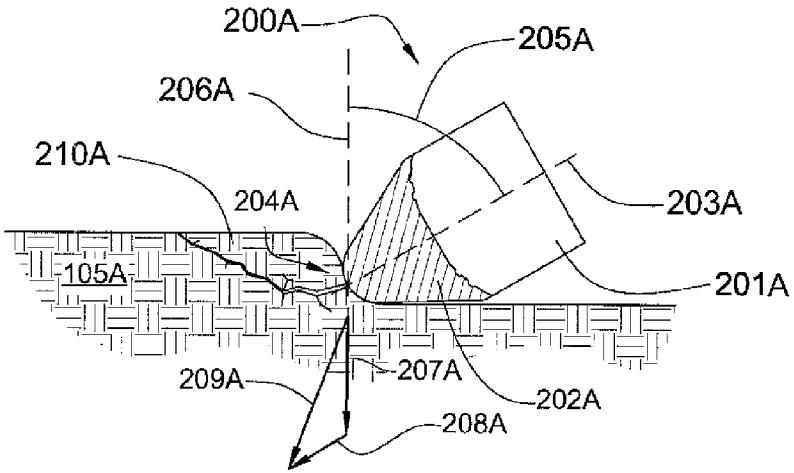
FIG. 2 is a cross-sectional diagram of an embodiment of a cutting element.

FIGS. 2 through 5 are cross-sectional diagrams of different embodiments of a cutting element 200 in communication with a formation 105. The cutting element 200 has a carbide substrate 201 bonded to a diamond working end 202 with a pointed geometry. The diamond working end 202 has a central axis 203 which intersects an apex 204 of the pointed geometry. The central axis 203 is oriented between a 25 and 85 degree positive rake angle 205. The angle 205 is formed between the central axis 203 of the diamond working end 202 and a vertical axis 206. In some embodiments, the central axis 203 is oriented between a 35 and 50 degree positive rake angle 205. FIG. 2 illustrates the cutting element 200 at a 60 degree positive rake angle 205. In this embodiment, the cutting element may be adapted for attachment to a drill bit, the drill bit operating at a low rotation per minute (RPM) and having a high weight on bit (WOB). As a result, a vector force 207 produced by the WOB may be substantially large and downward. A slow rotational speed, or low RPM, may produce a vector force 208 substantially pointing in a direction of the central axis 203 of the cutting element 200. Thus, the sum 209 of the vector forces 207, 208, may result in the cutting element 200 cutting a chip 210 from the formation 105 in a substantially wedge geometry as shown in the figure. The formation 105 being drilled may comprise limestone, sandstone, granite, or combinations thereof. It is believed that angling the cutting element 200 at the given positive rake angle 205 may produce cuttings having a unit volume of 0.5 to 10 cubic centimeters. Further, 40 to 60 percent of the cuttings produced may have said range of volumes.

A vertical turret lathe (VTL) test was performed on a cutting element similar to the cutting element shown in FIG. 2. The VTL test was performed at Novatek International, Inc. located in Provo, Utah. A cutting element was oriented at a 60 degree positive rake angle adjacent a flat surface of a Sierra White Granite wheel having a six-foot diameter. Such formations may comprise a Mohs hardness of 5.5 to 7. The granite wheel rotated at 25 RPM while the cutting element was held constant at a 0.250 inch depth of cut into the granite formation during the test. The apex of the diamond working end had a radius of 0.094 inch. The diamond was produced by a high pressure and high temperature (HPHT) method using HPHT containers or can assemblies. U.S. patent application Ser. No. 11/469,229, which is incorporated by reference for all that it contains, discloses an improved assembly for HPHT processing that was used to produce the diamond working end used in this VTL test. In this assembly, a can with an opening contains a mixture comprising diamond powder, a substrate being positioned adjacent and above the mixture. A stop-off is positioned atop the substrate as well as first and second lid. A meltable sealant is positioned intermediate the second lid and a cap covering the opening. The assembly is heated to a cleansing temperature for a period of time. The assembly is then heated to a sealing temperature for another period of time.

It was discovered that approximately 40 to 60 percent of the granite chips produced during the test comprised a volume of 0.5 to 10 cubic centimeters. In the VTL test performed at Novatek International, Inc., it was discovered that when operating under these specified conditions, the wear on the cutting element was minimal. It may be beneficial to produce large chips while drilling downhole in order to improve the efficiency of the drilling operation. Degrading the downhole formation by forming large chips may require less energy than a large volume of fines. During a drilling operation, drilling fluid may be used to transport cuttings formed by the drill bit to the top of the wellbore. Producing larger chips may reduce the wear exerted on the drill string by reducing the abrasive surface area of the broken-up formation.

Figure 3:
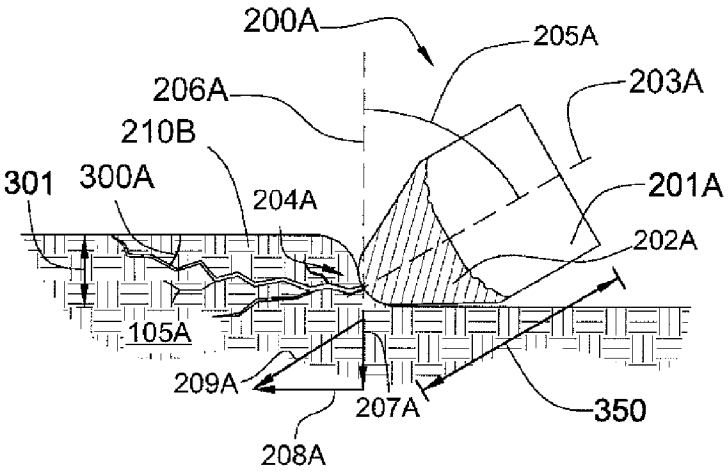
FIG. 3 is a cross-sectional diagram of another embodiment of a cutting element.

Referring now to FIG. 3, a cutting element 200 may be positioned at a 60 degree positive rake angle 205 adjacent the formation 105. In this embodiment, the cutting element 200 may be adapted for connection to a drill string operating at a high RPM and a low WOB. As a result, a downward force vector 207 produced by the WOB may have a relatively small magnitude while a force vector 208 produced by the RPM may be substantially horizontal. Although positioned at the same positive rake angle 205, the cutting element shown in FIG. 3 may produce a longer and narrower chip than the cutting element shown in FIG. 2 because of the differences in WOB and RPM. The chip 210 may comprise a substantially wedge geometry tapering at a 5 to 30 degree incline angle 300. The cutting element 200 may comprise a length 350 of 0.250 to 1.50 inches. It may be beneficial to have a cutting element comprising a small length, or moment arm, such that the torque experienced during a drilling operation may be minimal and thereby extending the life of the cutting element. The cutting element 200 may also produce a 0.100 to 0.350 inch depth of cut 301 during a drilling operation. The depth of cut 301 may be dependent on the WOB and RPM specific to the drilling operation. The positive rake angle 205 may also vary the depth of cut 301. For example, a cutting element operating at a low WOB and a high RPM may produce a smaller depth of cut than a depth of cut produced by a cutting element operating at a high WOB and a low RPM. Also, a cutting element having a larger positive rake angle may produce a smaller depth of cut than a cutting element having a smaller positive rake angle.

Figure 5:
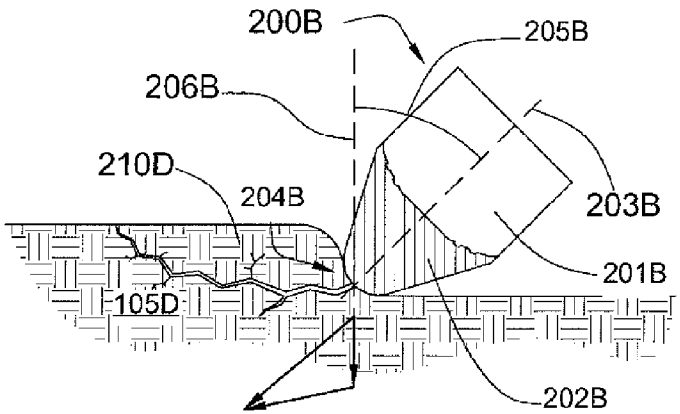
FIG. 5 is a cross-sectional diagram of another embodiment of a cutting element.
Figure 4:
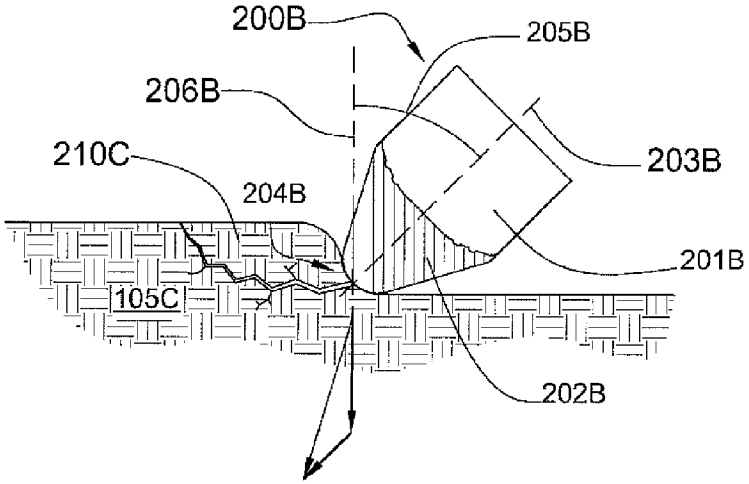
FIG. 4 is a cross-sectional diagram of another embodiment of a cutting element.

Smaller rake angles are shown in FIGS. 4 and 5. In these figures, a cutting element 200 is positioned adjacent a formation 105 at a 45 degree positive rake angle 205. In the embodiment of FIG. 4, the cutting element 200 may be adapted to have a high WOB and low RPM while the embodiment of a cutting element 200 shown in FIG. 5 may operate with a low WOB and high RPM. The chip 210 produced by the cutting element 200 in FIG. 4 may have a wedge geometry and may be have a greater incline angle than that of the chip 210 shown in FIG. 5.

Figure 6:
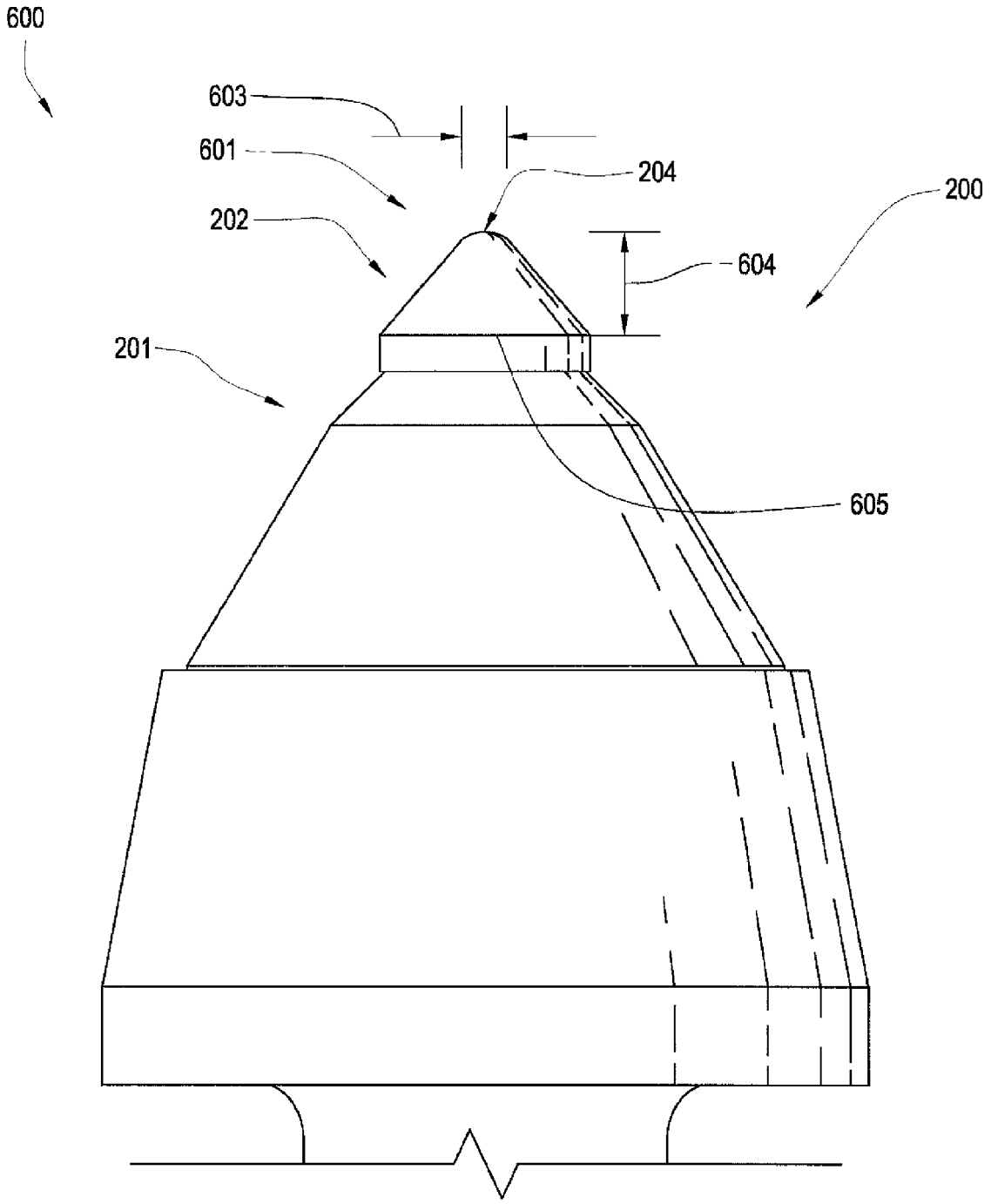
FIG. 6 is an orthogonal diagram of an embodiment of a high impact resistant tool.
Figure 19:
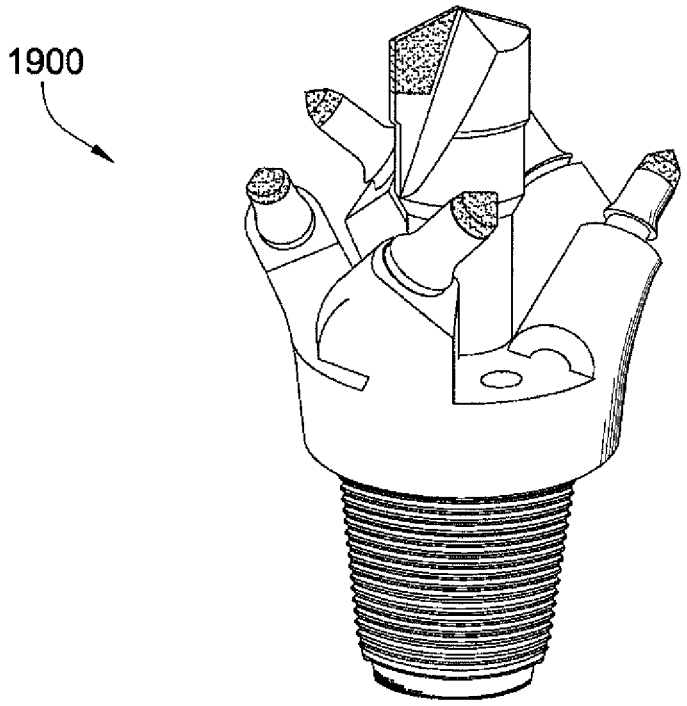
FIG. 19 is a perspective diagram of an embodiment of a drill bit.
Figure 20:
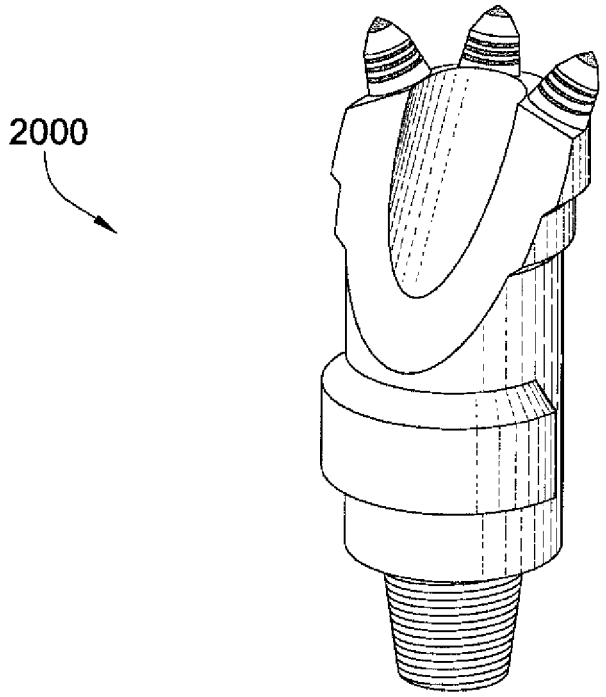
FIG. 20 is a perspective diagram of another embodiment of a drill bit.

Now referring to FIG. 6, the cutting element 200 may be incorporated into a high impact resistant tool 600, which is adapted for connection to some types of shear bits, such as the water well drill bit and horizontal drill bit shown in FIGS. 19 and 20. The cutting element 200 may have a diamond working end 202 attached to a carbide substrate 201, the diamond working end 202 having a pointed geometry 601. The pointed geometry 601 may comprise an apex 204 having a 0.050 to 0.200 inch radius 603. The diamond working end 202 may have a 0.090 to 0.500 inch thickness 604 from the apex 204 to a non-planar interface 605 between the diamond working end 202 and the carbide substrate 201. The diamond working end 202 may comprise diamond, polycrystalline diamond, natural diamond, synthetic diamond, vapor deposited diamond, silicon bonded diamond, cobalt bonded diamond, thermally stable diamond, infiltrated diamond, layered diamond, cubic boron nitride, diamond impregnated matrix, diamond impregnated carbide, metal catalyzed diamond, or combinations thereof. It is believed that a sharp thick geometry of the diamond working end 202 as shown in this embodiment may be able to withstand forces experienced during a drilling operation better than a diamond working end having a blunt geometry or a thin geometry.

Figure 7:
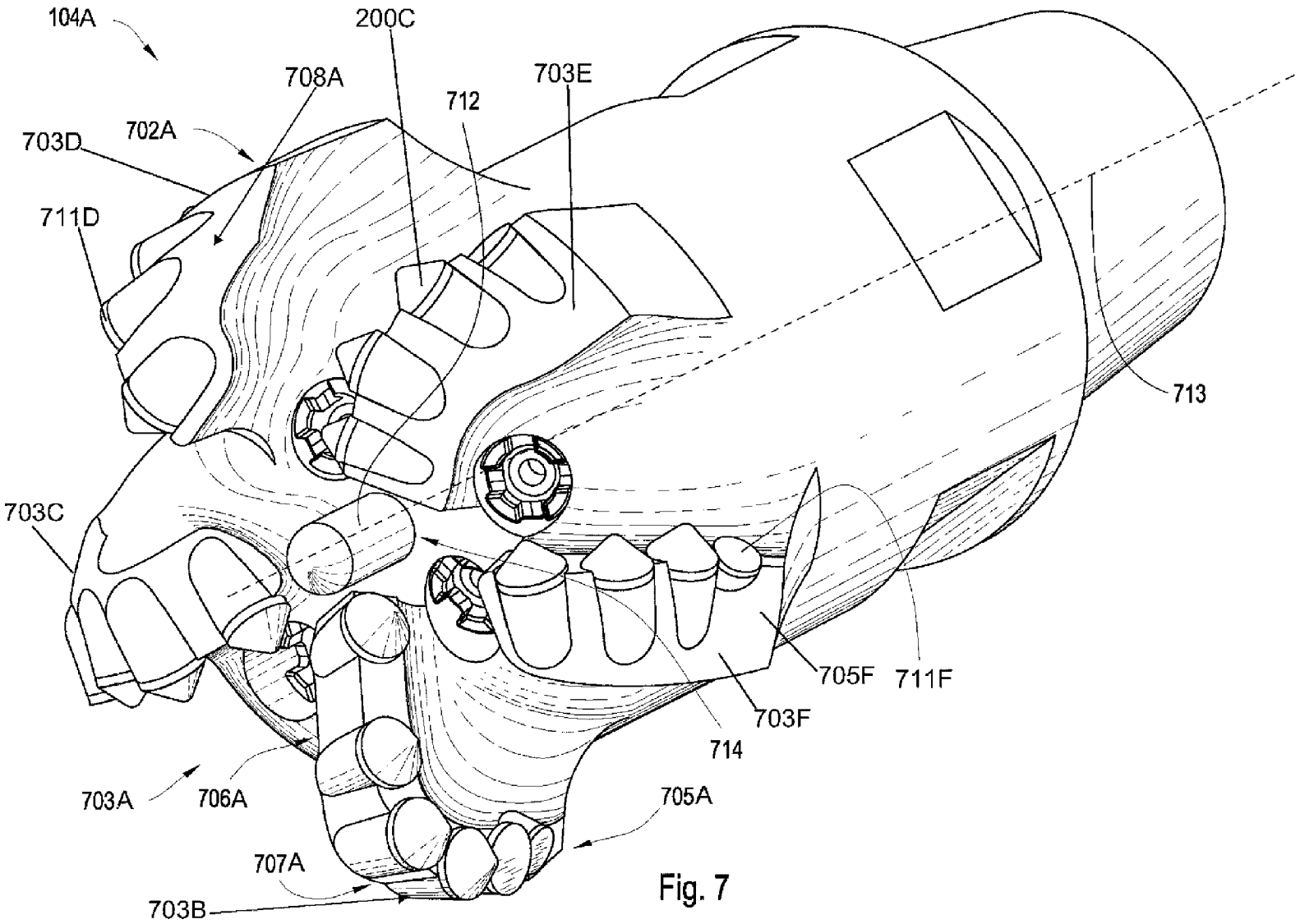
FIG. 7 is a perspective diagram of another embodiment of a drill bit.

In the embodiment of FIG. 7, a drill bit 104 may have a working face 702 having a plurality of blades 703 converging at a center of the working face 702 and diverging towards a gauge portion 705 of the working face 702. At least one blade 703 may have at least one cutting element 200 with a carbide substrate bonded to a diamond working end with a pointed geometry. Cutting elements 200 may be arrayed along any portion of the blades 703, including a cone portion 706, a nose portion 707, a flank portion 708, and the gauge portion 705. In this embodiment, at least one blade 703 may have at least one shear cutting element 711 positioned along the gauge portion 705 of the blade 703. In other embodiments, at least one shear cutting element may be arrayed along any portion of the blade 703. The shear cutting elements and pointed cutting elements may be situated along the blade in any arrangement. In some embodiments, a jack element 712 coaxial with an axis of rotation 713 may extend out of an opening 714 of the working face 702.

Figure 8:
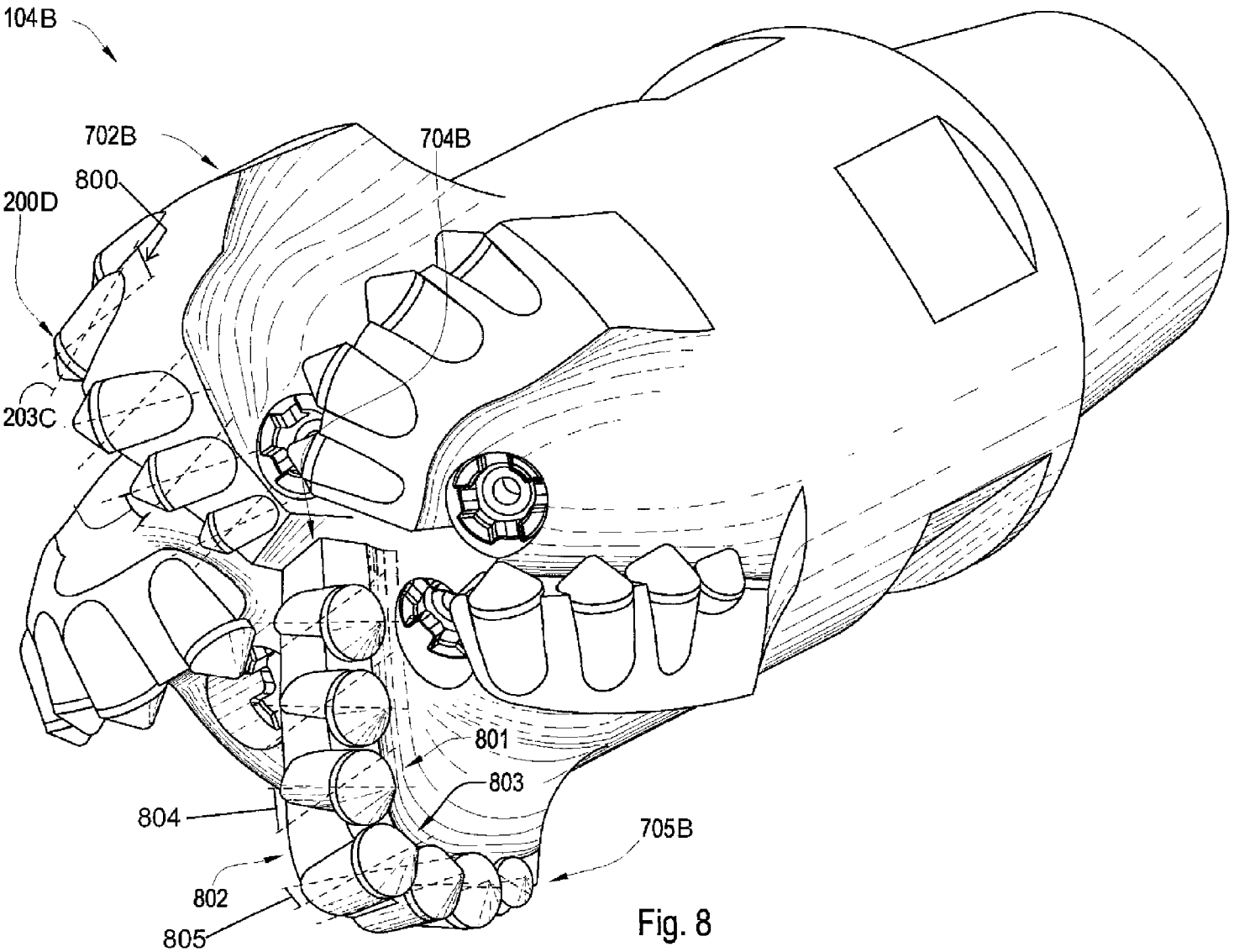
FIG. 8 is a perspective diagram of another embodiment of a drill bit.
Figure 9:
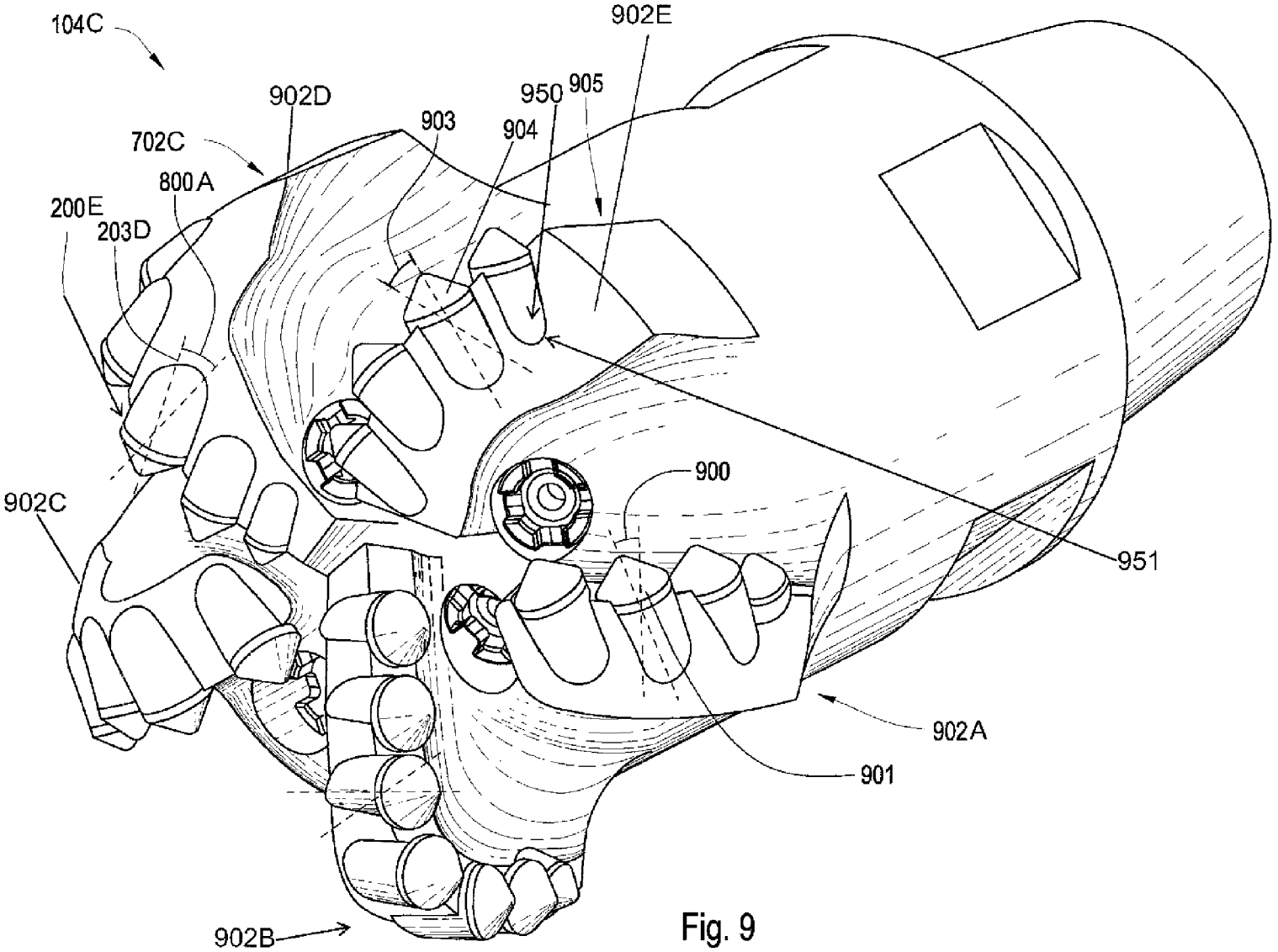
FIG. 9 is a perspective diagram of another embodiment of a drill bit.

Referring now to FIGS. 8 and 9, the central axis 203 of the cutting element 200 may be positioned at an angle 800 relative to a cutting path formed by the working face 702 of the drill bit 104 during a downhole drilling operation. It may be beneficial to angle the cutting elements relative to the cutting path so that the cutting elements may break up the formation more efficiently by cutting the formation into larger chips. In the embodiment of FIG. 8, a cutting element 801 on a blade 802 may be oriented at a different angle than an adjacent cutting element 803 on the same blade 802. In this embodiment, cutting elements 801 on the blade 802 nearest the center 704 of the working face 702 of the drill bit 104 may be angled away from a center of the circular cutting path while cutting elements 803 nearest the gauge portion 705 of the working face 702 may be angled toward the center of the cutting path. This may be beneficial in that cuttings may be forced away from the center of the working face and thereby may be more easily carried to the top of the wellbore.

FIG. 9 shows an embodiment of a drill bit 104 in which the angle 900 of at least one cutting element 901 on a blade 902 is offset from an angle 903 of at least one cutting element 904 on an adjacent blade 905. This orientation may be beneficial in that one blade having all its cutting elements at a common angle relative to a cutting path may offset cutting elements on another blade having a common angle. This may result in a more efficient drilling operation.

Figure 9A:
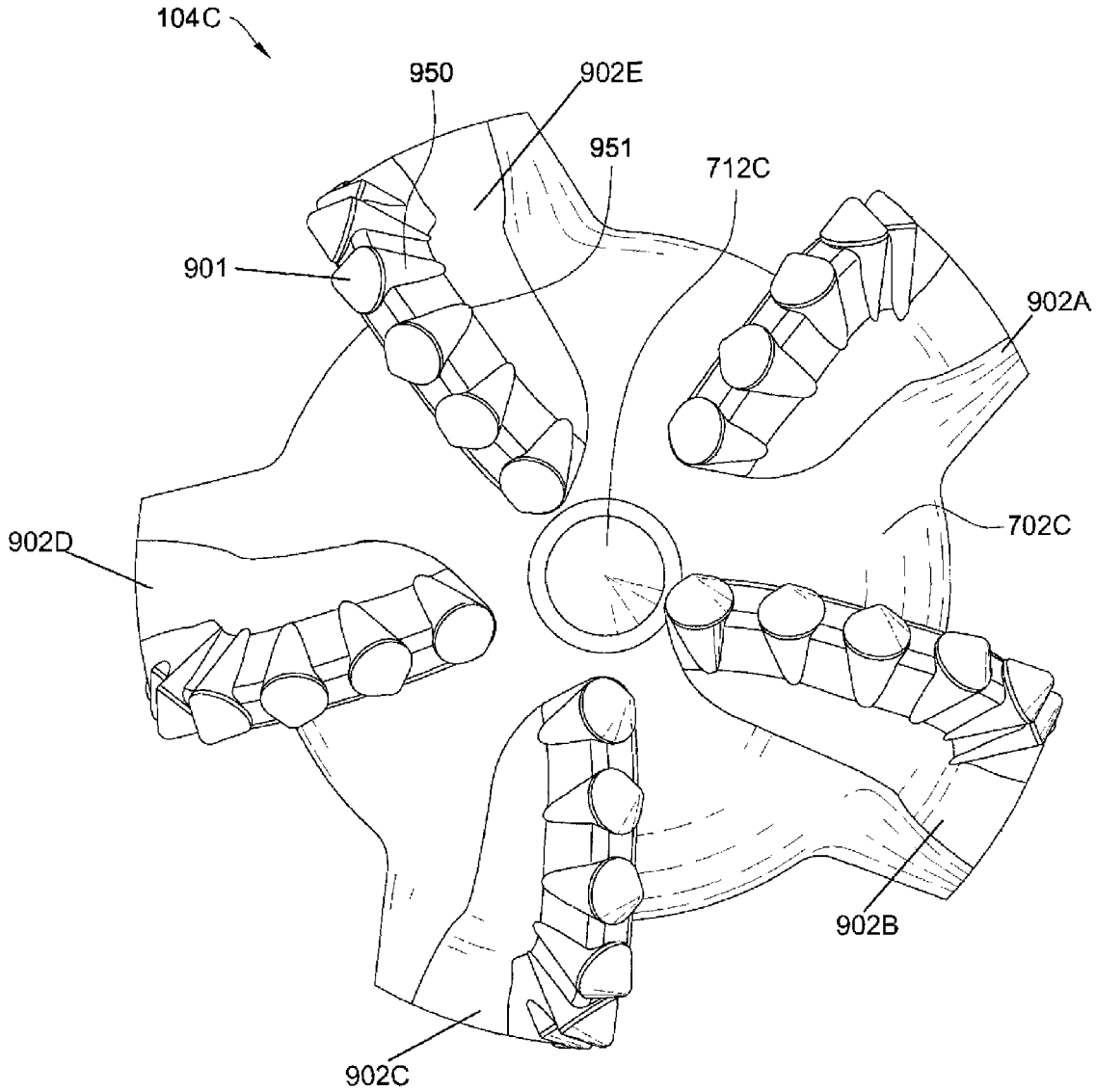
FIG. 9*a* is an orthogonal diagram of another embodiment of a drill bit.

FIG. 9*a* discloses a drill bit 104 with a plurality of cutting elements. At least on of the cutting elements is bonded to a tapered carbide backing 950 which is brazed into the blade 703. In some embodiments the taper may be between 5 and 30 degrees. In some embodiments, the blade 703 surrounds at least ¾ of the circumference of the tapered backing 950 proximate the cutting element. The combination of the taper and the blade 703 surrounding a majority of the circumference may mechanically lock the cutting elements in the blade. In some embodiments the proximal end 951 of the backing 950 may be situated in a pocket such that when a force is applied to the cutting element the force may be transferred through the backing 950 and generate hoop tension in the blade 703. A jack element 712 may protrude out of the working face 702 such that an unsupported distal end of the jack element 712 may protrude between 0.5 to 1.5 inches. In some embodiments, a portion of the jack element 712 supported by the bit body may be greater than an unsupported portion. In some embodiments, the bit body may comprise steel, matrix, carbide, or combinations thereof. In some embodiments, the jack element 712 may be brazed directly into a pocket formed in the bit body or it may be press fit into the bit body.

Figure 10:
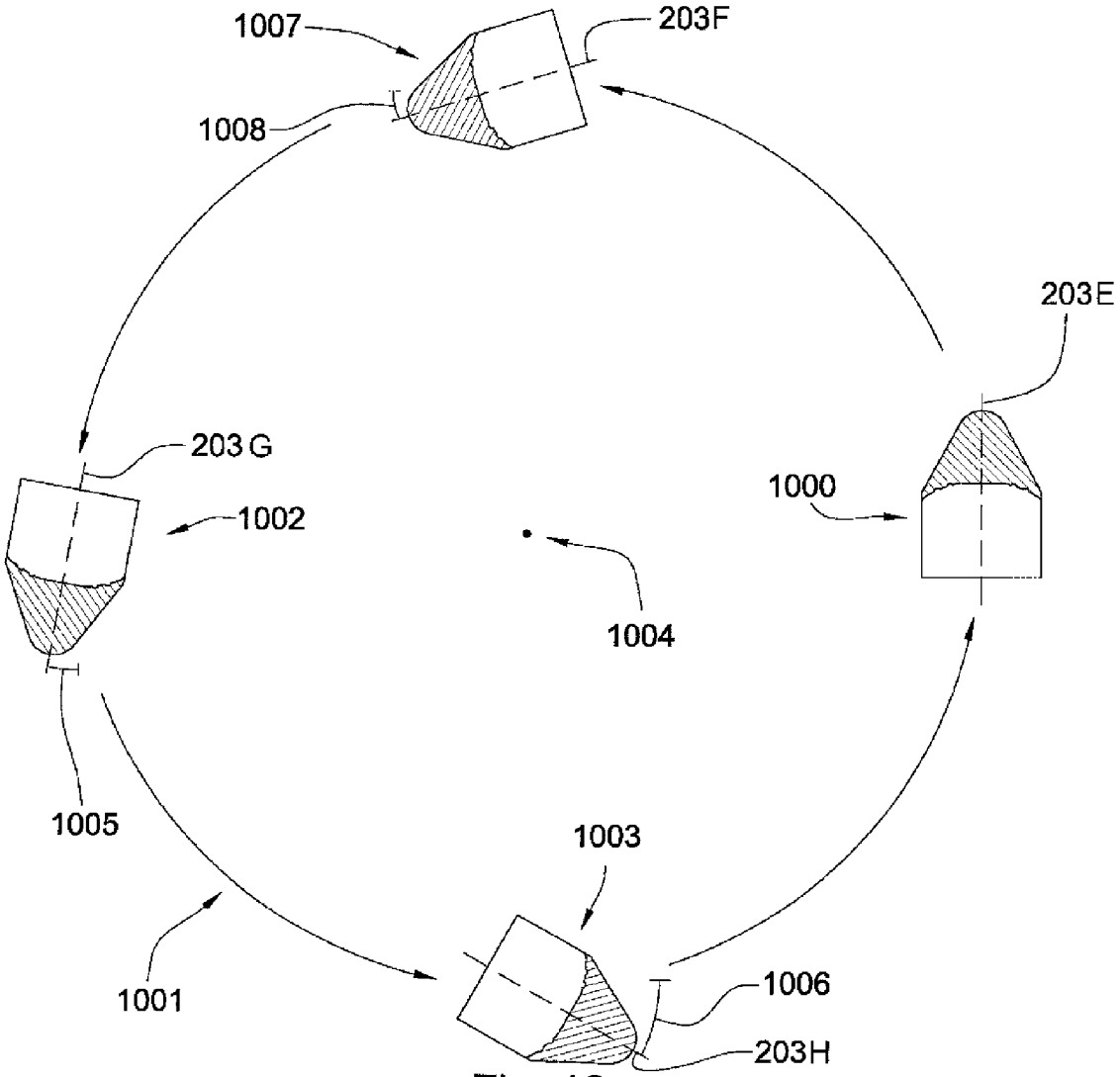
FIG. 10 is a representation of an embodiment a pattern of cutting element.

Referring now to FIG. 10, the central axis 203 of a cutting element 1000 may run tangent to a cutting path 1001 formed by the working face of the drill bit during a downhole drilling operation. The central axis 203 of other cutting elements 1002, 1003 may be angled away from a center 1004 of the cutting path 1001. The central axis 203 of the cutting element 1002 may form a smaller angle 1005 with the cutting path 1001 than an angle 1006 formed by the central axis 203 and the cutting path 1001 of the cutting element 1003. In other embodiments, the central axis 203 of a cutting element 1007 may form an angle 1008 with the cutting path 1001 such that the cutting element 1007 angles towards the center 1004.

Figures 11, 12, 13, 14, 15, 16, 17, 18:
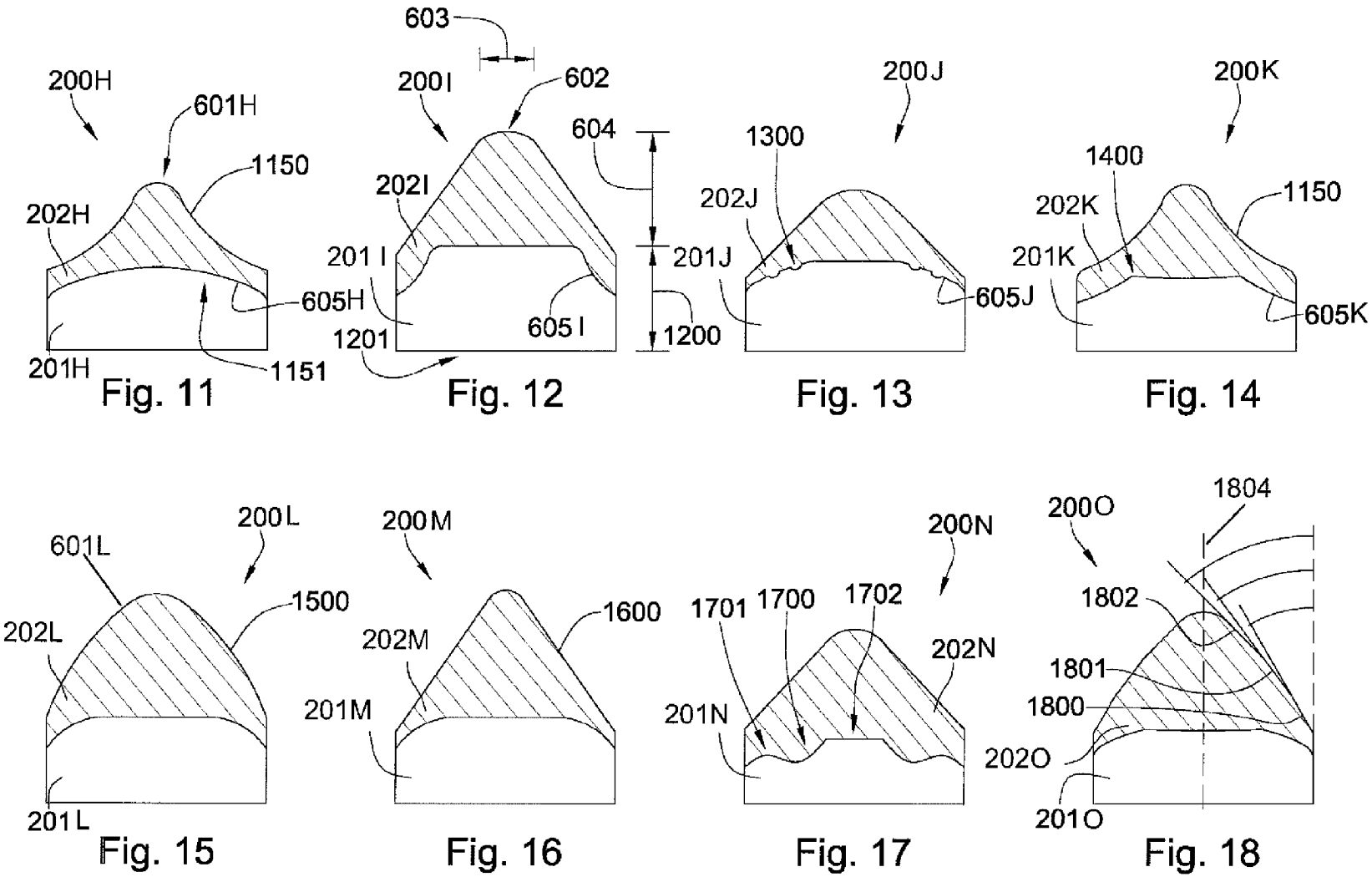
FIG. 11 is a cross-sectional diagram of another embodiment of a cutting element.
FIG. 12 is a cross-sectional diagram of another embodiment of a cutting element.
FIG. 13 is a cross-sectional diagram of another embodiment of a cutting element.
FIG. 14 is a cross-sectional diagram of another embodiment of a cutting element.
FIG. 15 is a cross-sectional diagram of another embodiment of a cutting element.
FIG. 16 is a cross-sectional diagram of another embodiment of a cutting element.
FIG. 17 is a cross-sectional diagram of another embodiment of a cutting element.
FIG. 18 is a cross-sectional diagram of another embodiment of a cutting element.

FIGS. 11 through 18 show various embodiments of a cutting element 200 with a diamond working end 202 bonded to a carbide substrate 201; the diamond working end 202 having a tapered surface and a pointed geometry. FIG. 11 illustrates the pointed geometry 601 having a concave side 1150 and a continuous convex geometry 1151 at the interface 605 between the substrate 201 and the diamond working end 202. FIG. 12 comprises an embodiment of a thicker diamond working end 202 from the apex 602 to the non-planar interface 605, while still maintaining a radius 603 of 0.050 to 0.200 inch. The diamond may comprise a thickness 604 of 0.050 to 0.500 inch. The carbide substrate 201 may comprise a thickness 1200 of 0.200 to 1 inch from a base 1201 of the carbide substrate 201 to the non-planar interface 605. FIG. 13 illustrates grooves 1300 formed in the substrate 201. It is believed that the grooves 1300 may help to increase the strength of the cutting element 200 at the interface 605. FIG. 14 illustrates a slightly concave geometry 1400 at the interface 605 with a concave side 1150. FIG. 15 discloses a slightly convex side 1500 of the pointed geometry 601 while still maintaining a 0.050 to 0.200 inch radius. FIG. 16 discloses a flat sided pointed geometry 1600. FIG. 17 discloses a concave portion 1700 and a convex portion 1701 of the substrate with a generally flatted central portion 1702. In the embodiment of FIG. 18, the diamond working end 202 may have a convex surface comprising different general angles at a lower portion 1800, a middle portion 1801, and an upper portion 1802 with respect to the central axis of the cutting element 200. The lower portion 1800 of the side surface may be angled at substantially 25 to 33 degrees from the central axis, the middle portion 1801, which may make up a majority of the convex surface, may be angled at substantially 33 to 40 degrees from the central axis, and the upper portion 1802 of the side surface may be angled at substantially 40 to 50 degrees from the central axis.

FIGS. 19 and 20 disclose various wear applications that may be incorporated with the present invention. FIG. 19 is a drill bit 1900 typically used in water well drilling. FIG. 20 is a drill bit 2000 typically used in subterranean, horizontal drilling. These bits 1900, 2000, and other bits, may be consistent with the present invention.

Figure 21:
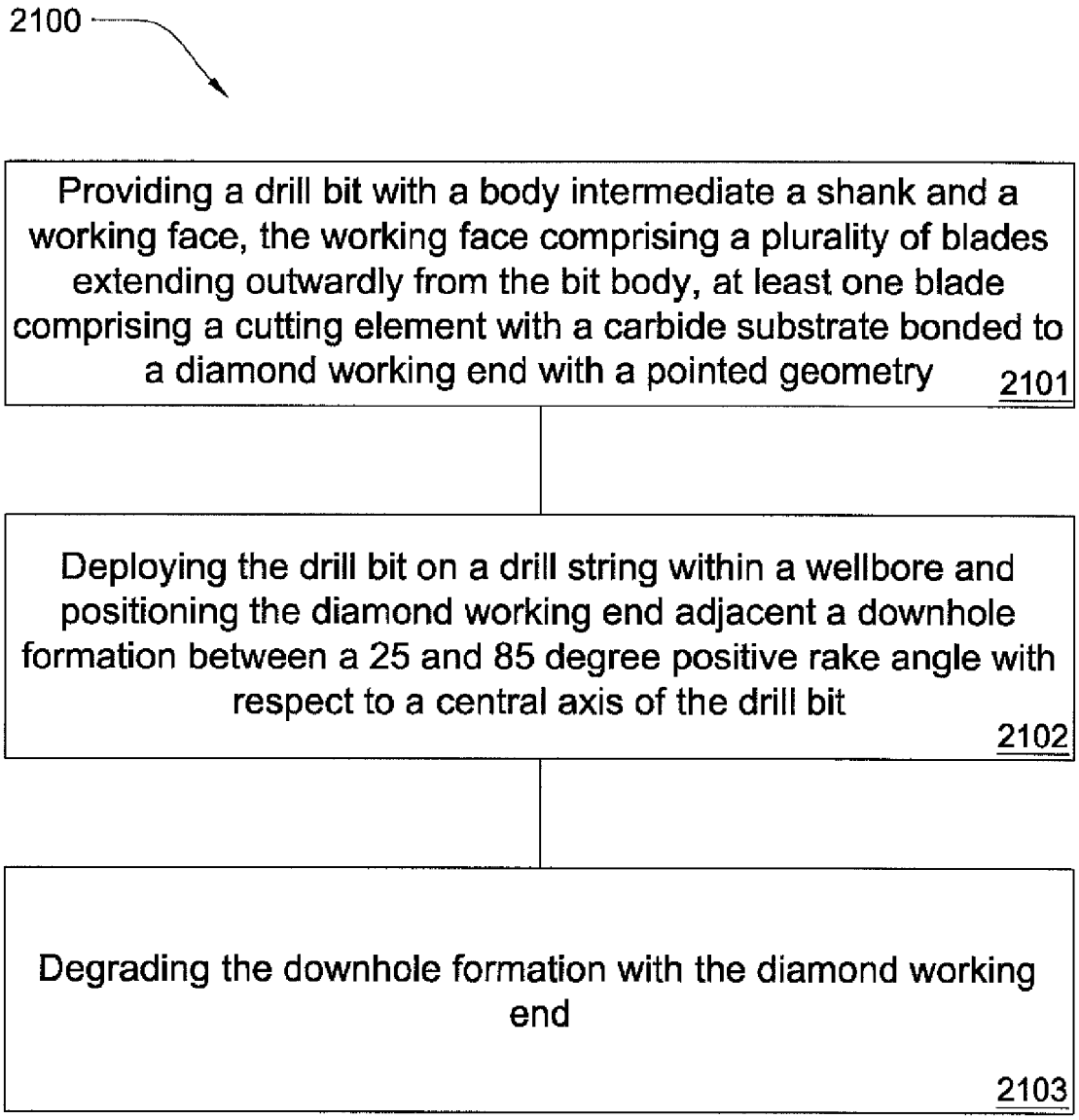
FIG. 21 is a diagram of an embodiment of a method for forming a wellbore.

FIG. 21 is a method 2100 of an embodiment for forming a wellbore. The method 2100 may include providing 2101 a drill bit with a body intermediate a shank and a working face, the working face comprising a plurality of blades extending outwardly from the bit body, at least one blade comprising a cutting element with a carbide substrate bonded to a diamond working end with a pointed geometry. The method 2100 also includes deploying 2102 the drill bit on a drill string within a wellbore and positioning the diamond working end adjacent a downhole formation between a 25 and 85 degree positive rake angle with respect to a central axis of the drill bit. The method 2100 further includes degrading 2103 the downhole formation with the diamond working end. 40 to 60 percent of the cuttings produced by the cutting element may have a volume of 0.5 to 10 cubic centimeters.

Whereas the present invention has been described in particular relation to the drawings attached hereto, it should be understood that other and further modifications apart from those shown or suggested herein, may be made within the scope and spirit of the present invention.

What is claimed is:

1. A drill bit for drilling into a formation, the drill bit comprising:

a shank;

a body having opposite ends with one of the opposite ends connected to the shank;

a working face at the other of the opposite ends, the working face having a center and a perimeter;

the working face comprising a plurality of blades extending outwardly therefrom from proximate a bit center to a gauge portion proximate the perimeter of the working face, at least one blade having a cone, nose, flank, and gauge portion; and at least one cutting element attached to each blade of the plurality of blades, the at least one cutting element terminating in a substantially pointed end and having a central axis oriented at an angle relative to a cutting path formed by the working face.

2. The drill bit of claim 1, wherein the at least one cutting element has a carbide substrate bonded to a diamond working end.

3. The drill bit of claim 2, wherein the diamond working end having a substantially pointed end has a radius ranging from 0.050 inch to 0.200 inch.

4. The drill bit of claim 2, wherein the cuttings formed by the at least one cutting element has a substantially wedge geometry tapering at a 5 to 30 degree angle.

5. The drill bit of claim 2, wherein the carbide substrate and the diamond working end have a non-planar interface therebetween, and wherein the diamond working end has a thickness from 0.090 inch to 0.500 inch from the substantially pointed end to the non-planar interface.

6. The drill bit of claim 1, wherein the body has an axis of rotation and wherein the body has an opening formed in the working face and wherein the body includes a jack element coaxial with the axis of rotation and positioned to extend out of the opening formed in the working face.

7. The drill bit of claim 1, wherein the at least one cutting element has a central axis angled towards a center of the working face.

8. The drill bit of claim 1, wherein the at least one cutting element has a central axis oriented at an angle different than an adjacent cutting element on the same blade.

9. The drill bit of claim 1, wherein the at least one cutting element has a central axis oriented at an angle different than at least one cutting element on an adjacent blade.

10. A method for forming a wellbore, the method comprising:

providing a drill bit having a shank for connection to a drill string for rotating the shank, a body having opposite ends with one of the opposite ends connected to the shank, a working face at the other of the opposite ends, the working face having a center and a perimeter, and comprising a plurality of blades extending outwardly therefrom from proximate a bit center to a gauge portion to engage the wellbore, at least one blade having a cone, nose, flank, and gauge portion, and at least one cutting element attached to each blade of the plurality of blades having a central axis oriented at an angle relative to a cutting path formed by the working face, each of the at least one cutting elements having a carbide substrate bonded to a diamond working end, the diamond working end being formed to have a pointed end to engage a formation through which the wellbore extends and;

deploying the drill bit on the drill string within the wellbore and positioning the drill bit so that the diamond working end engages the formation; and rotating the drill string and the drill bit to degrade the formation with the diamond working end of the at least one cutting element.

11. The method of claim 10, wherein the formation is rocklike, and wherein the central axis oriented at an angle relative to the cutting path is selected for the at least one cutting element to produce cuttings from the formation, 40 to 60 percent of the cuttings each having a unit volume of 0.5 to 10 cubic centimeters.

12. The method of claim 10, wherein the diamond working end has a pointed end having a radius ranging from 0.050 inch to 0.200 inch.

13. The method of claim 10, wherein the at least one cutting element has a central axis angled towards a center of the working face.

14. The method of claim 10, wherein the at least one cutting element has a central axis oriented at an angle different than an adjacent cutting element on the same blade.

15. The method of claim 10, wherein the at least one cutting element has a central axis oriented at an angle different than at least one cutting element on an adjacent blade.

16. A drill bit for drilling into a formation, the drill bit comprising:

a shank for connection to a drill string;

a body having a first end and a second end opposite the first end, the first end being connected to the shank;

a working face at the second end, the working face comprising a plurality of blades extending outwardly from a bit center to a gauge portion proximate the perimeter of the working face, at least one blade having a cone, nose, flank, and gauge portion; and at least one cutting element attached to the working face each blade of the plurality of blades and positioned to engage the formation, each of the at least one cutting elements having a carbide substrate bonded to a diamond working end at a non-planar interface, the diamond working end being formed to have a pointed end having a radius ranging from 0.050 inch to 0.200 inch and the cutting element having a central axis oriented at an angle relative to a cutting path formed by the working face.

17. The drill bit of claim 16, wherein the at least one cutting element has a central axis angled towards a center of the working face.

18. The drill bit of claim 16, wherein the at least one cutting element has a central axis oriented at an angle different than an adjacent cutting element on the same blade.

19. The drill bit of claim 16, wherein the at least one cutting element has a central axis oriented at an angle different than at least one cutting element on an adjacent blade.

20. The drill bit of claim 1, wherein the substantially pointed end of the at least one cutting element has a circular cross-section orthogonal to the central axis of the at least one cutting element.

* * * * *